US008627579B2

(12) United States Patent
Rotondi

(10) Patent No.: US 8,627,579 B2
(45) Date of Patent: Jan. 14, 2014

(54) HEAT GUN AIR FLOW-EXTENDERS

(75) Inventor: Anthony Rotondi, Brooklyn, NY (US)

(73) Assignee: Verizon New York Inc., New York, NY (US)

( * ) Notice: Subject to any disclaimer, the term of this patent is extended or adjusted under 35 U.S.C. 154(b) by 411 days.

(21) Appl. No.: 12/749,674

(22) Filed: Mar. 30, 2010

(65) Prior Publication Data

US 2011/0239483 A1 Oct. 6, 2011

(51) Int. Cl.
*F26B 25/00* (2006.01)

(52) U.S. Cl.
USPC ..... 34/104; 34/437

(58) Field of Classification Search
USPC ..... 34/104, 107, 437, 439, 443, 96–98, 34/283; 174/8, 9 R, 15.1, 16.1, 25 G, 26 G; 392/379–385
See application file for complete search history.

(56) References Cited

U.S. PATENT DOCUMENTS

| | | | | |
|---|---|---|---|---|
| 4,372,988 | A * | 2/1983 | Bahder | 427/541 |
| 4,967,060 | A * | 10/1990 | Lomeli | 392/384 |
| 4,972,065 | A * | 11/1990 | Ohlsen | 34/97 |
| 6,460,501 | B1 * | 10/2002 | Fischer et al. | 123/184.55 |
| 7,146,745 | B2 * | 12/2006 | Kent et al. | 34/104 |
| 2006/0036132 | A1 * | 2/2006 | Renner et al. | 600/160 |
| 2006/0273588 | A1 * | 12/2006 | Scartozzi | 285/404 |

* cited by examiner

*Primary Examiner* — Jiping Lu

(57) ABSTRACT

Apparatus and methodology for applying heated-air flow to wet or damp copper cable and specifically to individual mutually-insulated copper conductors within that cable including their respective paper sheath coverings. This cable can be used in telecommunications applications. Disclosed embodiments permit drying of difficult to reach wet/damp areas within a cable and between and amongst layers of wet/damp cable. A heat gun muzzle-insert attaches, at one end, to a heat gun barrel's muzzle end to extend hot air flow from the gun through the insert and through a plurality of tubes attached to its other end, This allows air flow to be pin-pointed at wet/damp areas otherwise not reachable without the tubes. The muzzle-insert attaches via threaded connection and is made from the same material as the gun to have the same thermal expansion characteristic. The hot air flow extender mechanisms can be modularized, each ha mg differently-sized pluralities of tubes.

12 Claims, 4 Drawing Sheets

HEAT GUN AIR FLOW-EXTENDERS

BACKGROUND

A copper wire cable can hold in multiple mutually-insulated copper wires. When those copper wires get wet, at one end of the cable, they can cause performance problems due to leakage and shorts from one wire to another and/or from any of the wet wires to ground. In telecommunication applications, cables are sometimes difficult to reach and, when wet, cannot be readily dried-out. For example, these cables can be used in underground man-holes which are small spaces with challenging configurations and underground wet cables need to be completely dried-out before service can be fully restored.

Furthermore, inside the outer protective layer of the cable, the mutually-insulated copper wires are also sometimes wrapped in paper sheaths. Paper sheath can absorb water like a sponge and draw it further back into the cable. Although the cable exterior covering can be stripped away up to a certain length (up to the cable choke) whereupon that length of individual mutually-insulated conductors in the cable can be exposed to dry them out, the wet paper sheaths that extend inside the cable beyond the choke under the protective exterior covering of the cable also need to be dried-out. This is difficult to do with conventional air blower techniques. In addition to this specific problem, there are other conditions under which a "rats nest" of copper-wire communication cables can get wet and for which a heated air flow cannot penetrate effectively to dry all wet surfaces. Thus, there is a need for applying heated air to dry-out wet surfaces of conductive copper cable that are hard to reach. Applicant's embodiments satisfy this need.

DETAILED DESCRIPTION OF PREFERRED EMBODIMENTS

Figure 1A:
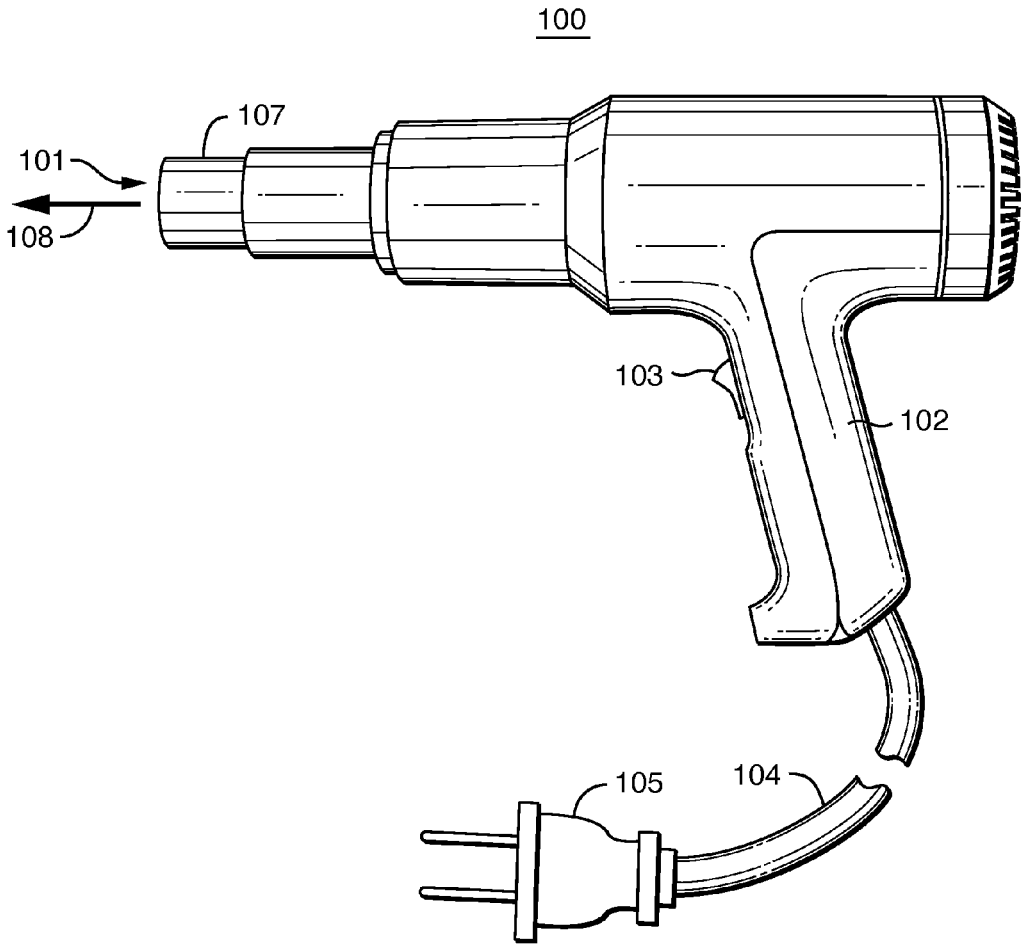
FIG. 1A is an exemplary schematic diagram of a conventional heat gun which may be used within apparatus of an exemplary embodiment.

In this description,. the same reference numeral in different Figs refers to the same entity. Otherwise, reference numerals of each Fig. start with the same number as the number of that Fig. For example, FIG. 3 has numerals in the "300" category and FIG. 4 has numerals in the "400" category, etc.

In overview, preferred embodiments include apparatus and methodology for drying a damp or wet electrical cable which has a number of damp or wet mutually-insulated electrical conductors. Hot air, or heated air, is generated by operation of a heat gun. The heat gun is configured to receive a special mechanism on the muzzle of the heat gun barrel. The mechanism includes a pipe and a number of flexible hot air flow conduits, such as, e.g., plastic tubes (hollow plastic cylinders), which extend outwardly from one end of the pipe. The other end of the pipe is directly, and removably, attached to the muzzle end of the barrel of the heat gun. The far ends of the plastic tubes make physical contact with the wet Conductors at difficult-to-reach areas. In this manner, hot air is applied from the heat gun, through the pipe, and through each of the individual conduits provided by the plastic tubes directly to the targeted wet areas inside the cable, those areas otherwise remaining difficult to reach without usage of this mechanism.

A preferred apparatus embodiment includes a heat gun having a barrel with a muzzle at the discharging end of the band l and a hot air flow-extender mechanism. The mechanism includes a muzzle-insert having two ends, attachable at one of those ends to the muzzle end of the barrel, the insert forming a conduit having an inner periphery, such as, for example, a pipe. There are a number of flexible tubes, the outsides of the tubes being permanently clumped or held together at one end of each of the tubes. These tubes are encircled at that end by the inner periphery of the pipe conduit located at the other end of the insert, and permit flow of heated air from the heat. gun there-through, thereby exiting from each one of the tubes. The clumped-together tubes, at their clumped-together end, can be permanently fastened inside the pipe conduit to each other and to the inside of the pipe by an adhesive or epoxy. The tubes are flexible, can be made from plastic, and the pipe can be made from metal that is the same as the metal of the heat gun, The pipe can thread into the muzzle end of the barrel if the outside of the pipe and the inside of the barrel have compatible threads and if the outside diameter of the pipe is equal to the inside diameter of the barrel. Or, in another embodiment, the muzzle end of the gun barrel can thread into the pipe if the outside of the barrel and the inside of the pipe have compatible threads and if the outside diameter of the barrel is equal to the inside diameter of the pipe.

Figure 1B:
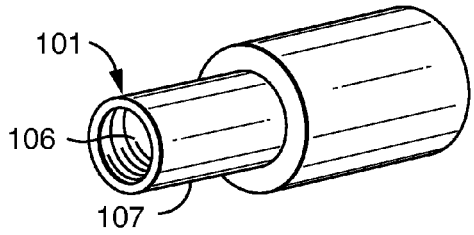
FIG. 1B is a perspective view of the barrel of the heat gun of FIG. 1A showing thread-inside the barrel adjacent its muzzle.

FIG. 1A is an exemplary schematic diagram of a heat gun 100 which may be used within apparatus, or with methodology, of an exemplary embodiment. This heat gun may be selected from commercially available models although hot air temperatures less than their maximum output capacity are employed with the apparatus and methodology of an exemplary embodiment, Alternatively, heat gun 100 can be a modified commercially-available model with hot air output held to an upper limit, e.g,, 175 degrees Fahrenheit and with on/off, air flow and air temperature controls provided via multi-purpose switch 103. If commercially-available heat guns are employed, there are controls provided that can independently regulate air temperature and velocity of the air along the heated air path, Muzzle 101, which is the discharging end portion of barrel 107 of the heat gun, is the location from which the heated air is ejected. Heat gun 100 has a handle-grip 102 for grasping by the hand of a service technician (not shown) and a finger-activated control switch 103 fm allowing the technician to activate and control heated air flow out of muzzle Finally, heat gun 100 has a power-cord 104 which connects to power plug 105 which is plugged into a power source (not shown) needed for operating the heat gun and for generating the essential heat energy. FIG. 1B is a perspective view of the end portion of the barrel of the gun of FIG. 1A at the location of its muzzle 101 showing threads 106 inside barrel 107 adjacent its muzzle 101.

Figure 2:
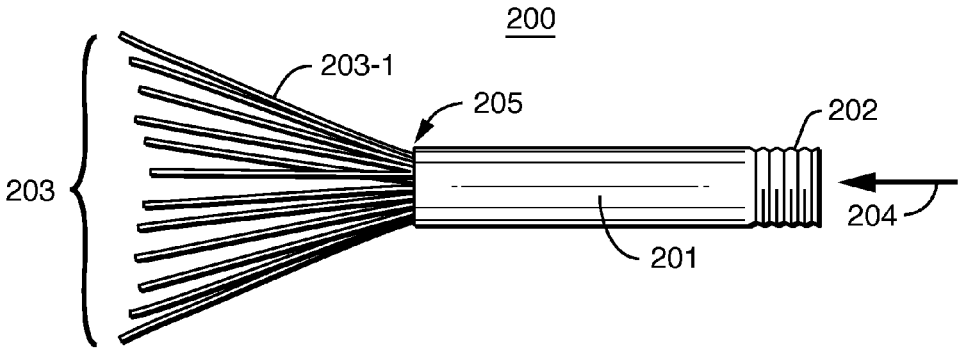
FIG. 2 is an exemplary schematic diagram of a muzzle-insert holding a number of heated-air flow-extenders, the muzzle-insert. capable of being firmly affixed to the muzzle-end of the barrel of the heat gun of FIG. 1.

FIG. 2 is a schematic diagram of an exemplary embodiment of a hot air flow-extender mechanism 200 including (11 a muzzle-insert and (2) a number of hot-air flow-extenders in accordance with principles of an exemplary embodiment. The muzzle-insert 201 is a barrel extension or a pipe and is capable of being firmly affixed to the muzzle portion of barrel 107 of heat gun 100 of FIGS. 1A/B Muzzle-insert (pipe) 201 can typically be three to six inches long, more or less, with no particular upper limit on pipe length, and can be made from metal and preferably from the same material or metal as the muzzle 101 of heat gun 100. Pipe 201 has a hollow interior to act as a conduit for hot air flow in direction 108 (FIG. 1A) or direction 204 (FIG. 2). Pipe 201 has a threaded exterior 202 comprising a number of threads for threading into, or grasping, other threads 106 shown in FIG. 1B which are configured inside barrel 107. It is preferable that the materials from which pipe 201 and barrel 107 are made have the same, similar, heat expansion characteristics because both pipe and barrel shall expand and contract together as a function of temperature rise and fall. Stability of interconnection, as well as ease of making connection or disconnection, between pipe 201 and barrel 107 may depend on those characteristics. If they are both made from the same material that would eliminate the possibility of one component expanding more than the other. In an alternative configuration, pipe 201 can have a very short length, e.g., about one inch, and be characterized as a ring, rather than a pipe, where the ring material matches the barrel material.

Figure 3:
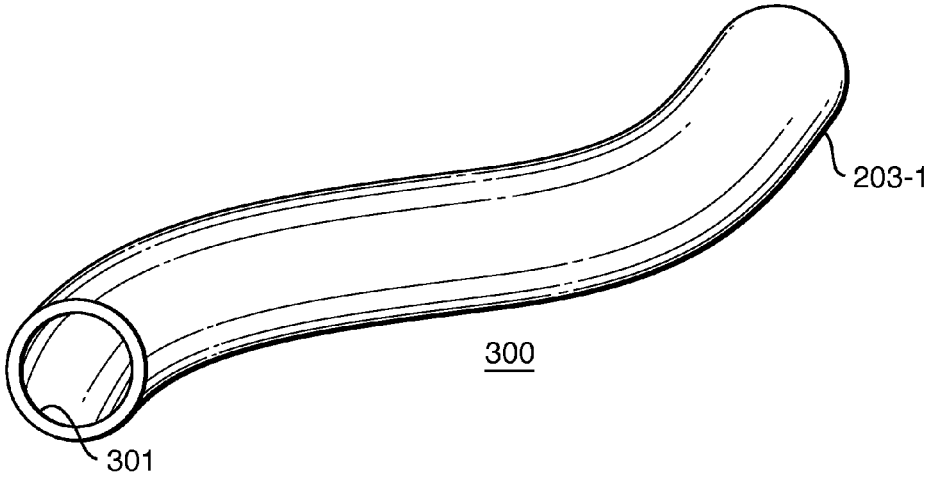
FIG. 3 is a perspective diagram of a portion of one of the heated-air flow-extenders which are shown in the aggregate in FIG. 2.

FIG. 2 also shows a plurality of hot-air flow-extenders 203 which are individual conduits attached to end 205 of pipe 201. In a particular embodiment flow-extenders 203 may number between forty and 100, and there can be fewer than forty and more than 100. These conduits may be made from flexible plastic tubes. A single conduit 203-1 is shown in FIG. 3 which is a perspective diagram of a portion of one tube, i.e., one of the hot-air flow-extenders shown in the aggregate in FIG. 2. The output end 301 of tube 203-1 is the place from which hot air is expelled and is the point of contact with wet insulation and/or wet paper sheath of a copper cable to which reference was made above.

In one particular embodiment, these tubes can be made from poly-vinyl-chloride (PVC.) which is capable of handling hot air flowing through its interior up to a limit of approximately 175 degrees Fahrenheit, and possibly higher on an intermittent basis. One possible source of PVC tubing is Plastixs LLC located in Shrewsbury, Massachusetts and there are other sources. Further, the length of these plastic conduits may each be approximately sixteen inches, more or less, and the inner diameters of the conduits may each be approximately one-sixteenth of an inch, more or less. The exact length and inner diameter can vary and, in certain applications, it may be advantageous to have longer or shorter tubing lengths and larger or smaller tubing inner diameters.

One feature of an exemplary embodiment is that other pipes 201, of varying lengths, can be prepared in advance with other sized plastic hot air-flow extenders (longer, shorter, thinner conduit, thicker conduit, etc.) so that the pipes with their respective extenders can be modularly interchanged at the end of heat gun 100 to better respond. to a particular wet cable configuration, Simply unscrew one pipe with its bunch of plastic air-flow extenders and screw on a different pipe, possibly of different length, with its different bunch of air-flow plastic extenders.

Figure 4:
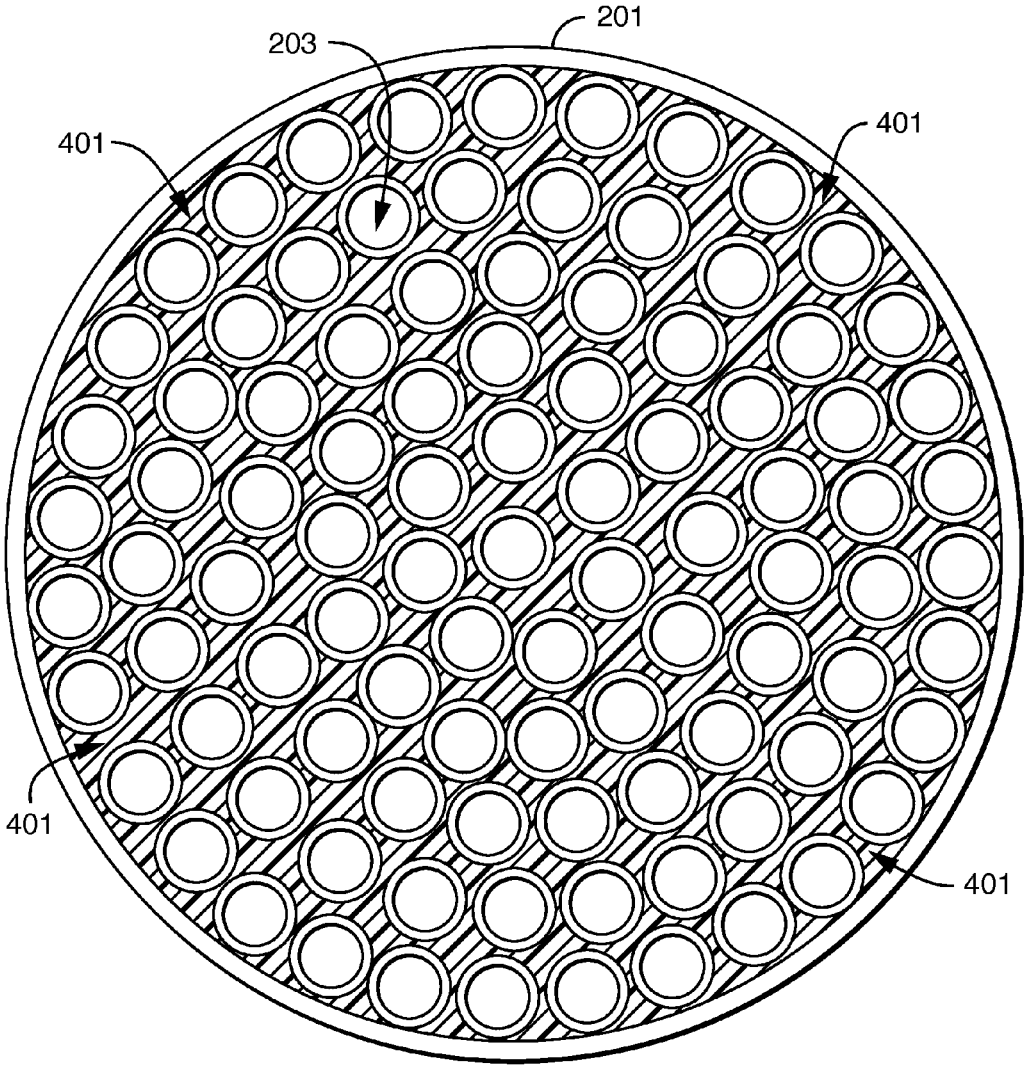
FIG. 4 is an end view of the aggregate of heated-air flow-extenders shown in FIG. 2, the aggregate being held together, and held inside one end of the muzzle insert, by epoxy or other adhesive material.

FIG. 4 is an end view of the aggregate of the heated-air flow-extenders 203 shown in FIG. 2. The view is taken in the direction 204, looking through pipe 201 from its threaded end. Extenders 203 are shown clumped-together and encircled or enveloped by pipe 201 at end 205. The cylindrically-shaped exterior surface of each one of the plurality of air-flow extenders 203 (plastic tubes) located inside pipe 201 is glued, epoxied or otherwise bonded via appropriate adhesive to exterior surfaces of abutting or adjacent extenders and/or to the inside of pipe 201. The result is a singular mass of extender tubes and hardened epoxy clumped-together at one end of those tubes affixed inside pipe 201, each tube retaining its open conduit characteristic. An epoxy-adhesive in the drawing is shown as cross-hatched space surrounding tubes 203 and, upon curing or hardening, is non-porous or non-permeable. Thus, all air flow is constrained to be only within and through the conduits of plastic flow extenders 203.

With respect to the PVC tubing of the particular embodiment noted above, one useful epoxy product is "Epoxy.com Product 4705 Two Component Flexible Adhesive" which provides a tenacious bond to PVC and also bonds to steel, and is rated to retain its adhesive properties at temperatures as high as 250 degrees Fahrenheit when subjected to intermittent exposure. (It is contemplated that the apparatus of an exemplary embodiment would be used intermittently, to achieve a drying effect on a particular wet cable, and not continuously.) This is merely an example of one commercially-available product; other bonding products of other chemical compositions can be used as well.

Hot air flow-extenders 203 may or may not be limp as a function of their chemical composition when the apparatus is turned-off and not causing air flow through the extenders. In either case, when the apparatus is turned-on and as air flow velocity is increased through extenders 203, they shall stiffen, or further stiffen. This reaction to air flow is useful for controlling the penetration of at least some of the flow-extenders from the entire group of flow extenders 203 into the core of a wet copper cable (i.e., into the open end of the cable) to reach hard to get at damp/wet areas such as the dampness that may be retained by paper sheath insulation.

As an aid in envisioning these damp, wet areas, Applicant makes further use of FIG. 4 by momentarily considering it to alternatively represent a copper wire cable end. That is, a copper wire cable core has mutually-insulated copper wires that might be represented, when viewed on end, by the multiplicity of circular entities 203, where one might envision ends of copper wires in lieu of the depicted conduits. Thus, although FIG. 4 is actually intended to be a depiction of one set of ends of plastic conduits included in an exemplary embodiment, nevertheless, a copper wire cable when viewed on end would have mutually-insulated copper wires that might generally resemble the presentation of FIG. 4.

There could be more or fewer copper wires than the number of circles 203 shown in FIG. 4, with concomitant less or more open space between the mutually-insulated wires in the copper wire cable as compared with the cross-hatch shown in FIG. 4. In other words, the cross-hatch space in FIG. 4, which actually represents solid, hardened epoxy or adhesive between plastic tubes 203 could, in addition, be momentarily envisioned as open space if FIG. 4 were envisioned as an end-view depiction of a copper wire cable. Then, under that transformed and momentary interpretation of FIG. 4, some of the tube-conduits 203 of FIG. 2, when stiff from hot air flow, if pressed by a technician against and into that open end of a copper wire cable, can slide between the mutually-insulated copper conductors given sufficient cross-hatched open space, and reach the otherwise unreachable wet/damp areas, The wet/damp areas are located under the cable's protective outer layer and were previously difficult to reach, or were not reachable at all, by drying air applied to that open end of copper wire cable without the extended reach capability provided by individual conduits of the preferred embodiments.

Figure 5:
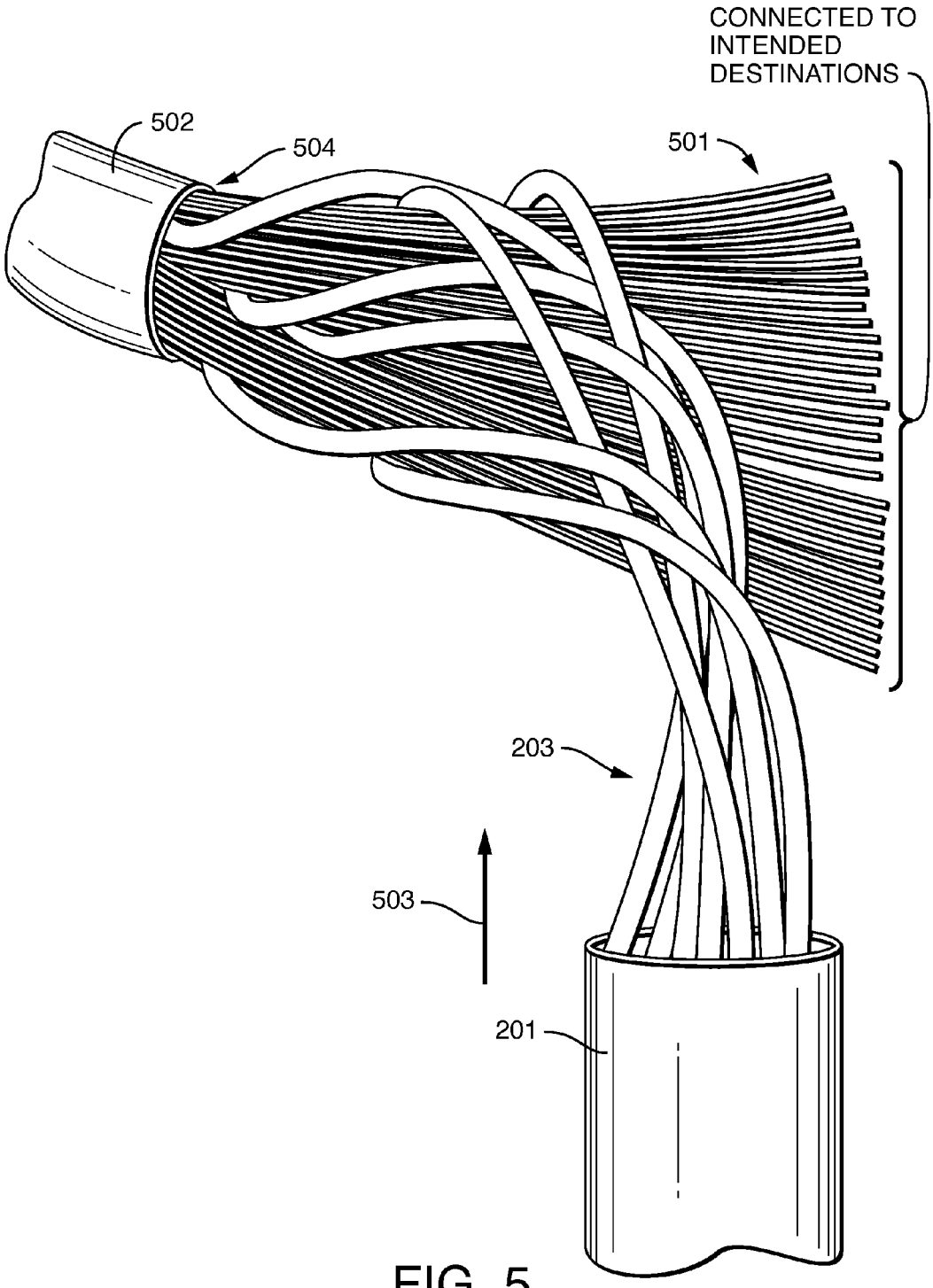
FIG. 5 is an exemplary schematic diagram of heated-air-flow extenders of FIGS. 2 and 4 making physical contact with a plurality of electrical conductors exposed outside of their protective cable-exterior.

FIG. 5 is an exemplary schematic diagram of the heated-air-flow extenders 203 of FIGS. 2 and 4 as they make contact with a plurality of electrical conductors 501. Conductors 501 can be individually-insulated intact conductors, and/or paper-sheath-stripped conductors, shown outside of their protective cable exterior 502, both types being depicted identically to enhance clarity of presentation. The electrical cable at end location 504 was earlier referred to as the cable choke. The outer cable protective shield 502, and other selected cable insulations for individual conductors can be stripped back to the cable choke. location 504, as shown in FIG. 5. Not every electrical conductor necessarily has its insulation stripped back to the cable choke; insulation is stripped only to the extent deemed necessary by a servicing-technician to allow for effective drying of wet conductors by hot air flowing through tubes 203 and blowing onto those wet conductors and surrounding wet areas.

Electrical conductors 501 are not shown connected to their respective intended terminals or other connections, but it should be understood that each of those conductors extends beyond its depicted length and is routed to its respective conductive-destination, although all electrical conductors could be intentionally disconnected before servicing if deemed desirable by the technician. In FIG. 5, pipe 201 is shown with the ends of at least a portion of its embedded (clumped-together) group of flow-extenders 203 touching wet or damp locations between and amongst individual mutually-insulated copper wires 501 and/or individual non-insulated copper wires 501 in the copper wire cable contained within outer protective layer 502. In other words, hot air contact can be made with some conductors which are intact, with others that have their paper sheath insulation removed, with others that can be stripped to bare copper wire, and if there is yet other insulation involved it can be stripped, or not, on a selective basis by the technician - or with all conductors stripped precisely the same way.

Hot air flows in direction 503 through individual tubes 203 to individual locations between and amongst wet or damp copper wires 501 for purposes of drying-out those locations. Flow extenders 203 are flexible and, when the ends of the plastic tubes 203 are pressed by the serviceman or technician against the mass of conductors 501 in the vicinity of cable choke 504, the extenders 203 form curvilinear shapes shown. Flow extenders 203, when not in operation, can be relatively stiff as shown in FIG. 2 or can be relatively flexible as shown in FIG. 3, depending upon the type, and chemical composition, of plastic used to make those flow extender tubes.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. For example, instead of the heat gun barrel having threads formed inside the barrel, those threads could be formed on the outside of the barrel, where the companion barrel extender pipes would then have threads on their insides. This alternative embodiment may offer a slightly reduced resistance to air flow from the heat gun as compared with the exemplary embodiment described above, For another example, threads can be formed on both the inside and on the outside of the same barrel to accommodate both outside and inside threaded pipe extenders, respectively, where only one extender is used at any given time.

In addition, other tubing compositions can be used. For example, polyurethane flexible tubing is capable of retaining its operating characteristics up to approximately 165 degrees Fahrenheit, and is available in one-eighth inch outside diameter and one-sixteenth inch inside diameter size from the Freelin-Wade Company located in McMinnville, Oreg., and there are other sources. As a further alternative, nylon tubing can be used which can withstand temperatures up to approximately 200 degrees Fahrenheit; and silicone tubing or commercial rubber can be used for hot air temperatures above that. The present invention is thus not to be interpreted as being limited to particular tubing compositions and/or particular temperature limits, rather, any suitable tubing, available now or in the future, is intended to be embraced within the purview of the present invention.

Furthermore, a product resulting from a process of extrusion of any of these, or other, plastic-related materials which would provide an extruded multiplicity of hollow tubes with each of their outside surfaces at the same end of those tubes inherently connected together, such inherent connection thereby providing a functional equivalent to the cross-hatched epoxy of FIG. 4, is also contemplated as a workable component of the present invention. Therefore, the specification and drawings are to be regarded in an illustrative rather than restrictive sense.

What is claimed is:

1. Apparatus comprising:

a beat gun having a barrel with a muzzle at the discharging end of said barrel; and a hot air flow-extender mechanism comprising:

a muzzle-insert having two ends, attachable at one end of said insert to said barrel, said insert forming a conduit having, an inner periphery with conduit input at said one end and conduit output having no more than one opening, said one opening, disposed at said other end;

a plurality of flexible tubes, each of said tubes having two ends, outsides of said tubes being permanently clumped together at only one end of said each of said tubes, said clumped-together plurality of tubes being encircled, at said only one end of said each of said tubes by said inner periphery of said conduit output, said encircled plurality of tubes permitting heated air from said heat gun to flow through said each of said tubes and exit only from the other end of said each of said tubes: and means for permanently fastening said one end of said clumped-together tubes to said conduit.

2. The apparatus of claim 1 wherein said encircled plurality of tubes is further configured by being snugly encircled by said inner periphery to permit flow of heated air from said heat gun only through and only exiting from said each said tube.

3. The apparatus of claim 2 wherein said tubes are made from plastic or rubber and wherein said tubes are each of approximately equal length.

4. The apparatus of claim 3 wherein said conduit is a ring or a pipe and said plastic tubes are made from PVC.

5. The apparatus of claim 4 wherein said ring or said pipe is made from metal.

6. The apparatus of claim 5 wherein said fastening means includes adhering-epoxy to bind to said inner periphery of said metal ring or said metal pipe.

7. The apparatus of claim 6 wherein said adhering-epoxy is a two component flexible adhesive formulated to bond said plastic PVC tubes to each other as said permanently clumped, together tubes.

8. The apparatus of claim 5 wherein said barrel further comprises fastening-threads formed into the interior surface of said barrel adjacent said discharging end of said barrel.

9. The apparatus of claim 8 wherein said ring or pipe further comprises fastening threads formed into the exterior surface of said ring or pipe and configured to matingly-receive said fastening threads of said barrel by rotating said fastening threads of said ring or pipe into said fastening. threads of said barrel, and thereby controllably attach said ring or pipe to said barrel.

10. The apparatus of claim 1 wherein said apparatus is modularly configured by having said mechanism comprise any one of a multiple number of muzzle-inserts each of which can controllably attach to, and detach from, said barrel, and wherein each of said multiple number of muzzle-inserts is permanently fastened to a different plurality of flexible tubes, each said different plurality including tubes conforming to a different common tube conduit diameter or common length.

11. The apparatus of claim 1 wherein said barrel further comprises fastening-threads formed into the exterior surface of said barrel adjacent said discharging end of said barrel.

12. The apparatus of claim 11 wherein said conduit is a ring or pipe which further comprises fastening threads formed into the interior surface of said ring or pipe and configured to matingly-receive said fastening threads of said barrel by rotating said fastening threads of said barrel into said fastening threads of said ring, or pipe, and thereby controllably attach said ring or pipe to the outside of said barrel.

* * * * *